US005152520A

United States Patent [19]

Farrell et al.

[11] Patent Number: 5,152,520

[45] Date of Patent: Oct. 6, 1992

[54] UNIVERSAL NON-DEDICATED HIGH CAPACITY FEEDER

[75] Inventors: Grant D. Farrell, Pickering, Canada; Peter A. Sardano, Fairport, N.Y.; Douglas W. Gates, Rochester, N.Y.; David J. Fish, Webster, N.Y.; Gerald R. Sturnick, Rochester, N.Y.

[73] Assignee: Xerox Corporation, Stamford, Conn.

[21] Appl. No.: 630,590

[22] Filed: Dec. 20, 1990

[51] Int. Cl.[5] ..... B65H 3/06

[52] U.S. Cl. ..... 271/10; 271/147; 271/164

[58] Field of Search ..... 271/162, 164, 10, 147

[56] References Cited

U.S. PATENT DOCUMENTS 4,436,406 3/1984 Murasaki ..... 271/164 X 4,958,823 9/1990 Iwaki ..... 271/164 X

*Primary Examiner*—Richard A. Schacher

[57] ABSTRACT

A recording apparatus includes a two-piece universal non-dedicated high capacity feeder. The high capacity feeder has separate paper storage/handling and interface modules that enhance easy adaptation to most recorders by modification of only the interface module. Easy removal of the interface module from the cassette insertion slot of the recorder is made without disconnection of the paper handling module in order to make the slot available for any number of conventional cassettes.

19 Claims, 3 Drawing Sheets

UNIVERSAL NON-DEDICATED HIGH CAPACITY FEEDER

This invention relates to a paper feeder for an apparatus for recording images, data and the like on paper, hereinafter referred to as a recording apparatus, and more particularly to a high capacity paper feeder for such an apparatus.

Customer usage and daily copy volumes for low/mid volume recording apparatuses has increased in recent years due to the introduction of products having enhanced features and dramatically improved copying flexibility. This increased usage has created the need to expand the size of the recording apparatus throughput paper supply beyond the conventional 250 or 500 sheet cassette tray. The increased capacity is necessary to avoid an undesirable impact to the tray reloading frequency during heavy use.

This situation has resulted in the development of the high capacity feeder that is presently available in several basic configurations but in all cases the principle is to provide a recording apparatus throughput paper source capable of holding up to about 2600 sheets. It consists of a paper elevator, usually motor driven, with paper separating and handling interface all in a modular two unit construction. The interface to the recording apparatus is through a conventional cassette tray slot for an externally mounted high capacity feeder or via a dedicated paper pickup and handling module for a feeder mounted internal to the recorder/stand combination.

One problem with these units, particularly on the new highly-automated processors, is that one cassette slot is permanently dedicated to the high capacity feeder, resulting in a restriction of the range of paper sizes which can be automatically selected from the remaining cassette positions. The second problem is that the feeders are designed as a single unit including the interface feature. Due to subtle differences in the configuration and relative position of the cassette slot for each new recording product, it becomes necessary to design, develop and manufacture a complete new high capacity feeder unique to each new recorder line.

Previous high capacity paper feeders include U.S. Pat. No. 4,436,406 which discloses a paper feeder that has a recording paper accommodating unit for accommodating a larger number of sheets of recording paper than cassettes, the unit having a sheet feeder for feeding recording paper out of the unit, and releasable engaging hooks for removably attaching the unit to the main body of a recording apparatus. The apparatus drive is connected to the sheet feeder when the unit is attached to the main body, whereby the unit is attached to the main body with a multiplicity of sheets of recording paper accommodated therein for transport into the recording apparatus. In U.S. Pat. No. 4,718,658, a sheet feeding system for use in an image processing device is shown that includes a sheet storage unit having a vertically movable sheet tray on which a large number of sheets can be stacked. The united system body of the image forming unit and a pedestal on which the image forming unit is mounted defines a holder cavity for permitting the sheet storage unit to be put thereinto so as to enable the stacked sheet in the sheet storage unit to be sent into the image forming unit one by one.

Other patents include U.S. Pat. No. 3,687,303 which discloses a device for removing a desired number of plates from a stack of plates. A knife member is brought into contact with the side of a certain plate in a stack thus locating a desired number of plates between the knife and one end of the stack. In U.S. Pat. No. 3,843,115, an elevator apparatus for raising and lowering a platform is shown which includes a lift mechanism that is supported by a frame F and is manipulated by a motor and a series of gears. A sheet feed assembly is disclosed in U.S. Pat. No. 3,887,178 that includes a tilting plate for aligning sheets on a tray. A rack and pinion meshing arrangement is shown that is used to raise and lower a plate in the assembly. U.S. Pat. No. 4,007,925 is directed to a sheet feeder which includes a fixed platform and a vertically movable platform for supporting a stack of sheets. A feed roller means exerts uniform and equal forces to a sheet in order to provide for accurate and positive feeding of the sheet from the stack. In U.S. Pat. No. 4,021,710, a speed control system which includes a mechanical sensor for sensing the position of the top of a stack of sheets. Upon detection of a too slow advance of a stack, a monostable multivibrator energizes a relay which in turn applies a voltage to a winding of a servo motor to increase the speed of advance of the stack. A sheet feeding apparatus having a sheet feeding tray for supporting sheets thereon is shown in U.S. Pat. No. 4,273,323 which is adapted to be moved out of the machine for replenishing or replacing of sheets. A drive motor is provided for moving the sheet feeding frame into and out of the machine and vertically moving the sheet feeding tray within the sheet feeding frame.

In U.S. Pat. No. 4,307,878, a paper feed mechanism is disclosed that includes interchangeable cassettes a feed roll which engages the uppermost sheet of an operatively positioned cassette. The cassette is separably and replacably disposed and retained in the apparatus by a stop attached to the main body of the mechanism. U.S. Pat. No. 4,457,508 is directed to a stack control apparatus for sheet feeders which includes a stack height sensing device synchronized with rotation cycles of a machine. An article unstacking system which has an inclined support wall and a carriage reciprocatively movable parallel to the support wall is shown in U.S. Pat. No. 4,710,089. The carriage is moved upwardly until the top article is engaged by a discharge roller which lifts it from and peels it off the stack. U.S. Pat. No. 4,718,658 shows a sheet feeding system which comprises a sheet storage unit having a vertically movable sheet tray onto which a large number of sheets can be stacked. Great Britain Patent 1,159,331 discloses an apparatus for transferring a stack of articles which comprises a separator, insertible between a pair of contiguous articles, used to separate the stack of articles to be transferred. A predetermined length of a column of contiguous articles can thus be transferred.

Accordingly, an improved, two piece universal non-dedicated high capacity feeder is disclosed consisting of separate paper storage/handling and interface module. It permits easy adaptation to most recording products by modification of only the interface module; and it permits easy removal of the interface module from the cassette tray slot of the recording apparatus without disconnection of the paper handling module from the recording apparatus, so that the slot can be available for any of the normal recording apparatus cassettes.

The above-mentioned features and others of the invention, together with the manner of obtaining them, will best be understood by making reference to the following specification in conjunction with the accompanying drawings, wherein.

Figure 1:
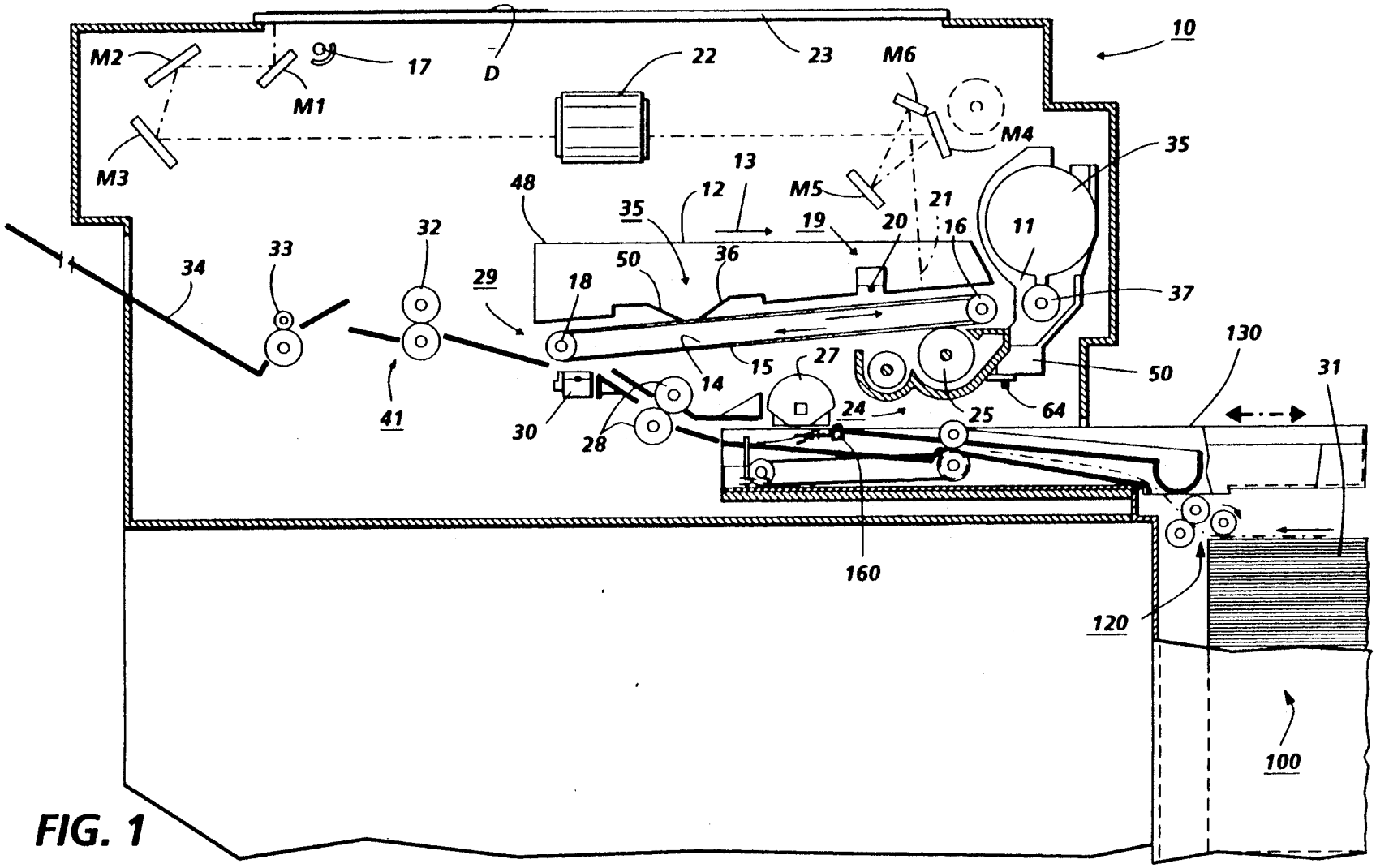
FIG. 1 is a schematic elevational view showing an electrophotographic recording apparatus employing the features of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements.

Inasmuch as the art of electrophotographic recording is well known, the various processing stations employed in the FIG. 1 recording machine will be shown hereinafter schematically and their operation described briefly with reference thereto.

Referring now to FIG. 1, there is shown by way of example, an automatic electrostatographic recording machine 10 which includes a removable processing cartridge. The reproducing machine depicted in FIG. 1 illustrates the various components utilized therein for producing copies from an original document. Although the apparatus of the present invention is particularly well adapted for use with automatic electrostatographic reproducing machines, it should become evident from the following description that it is equally well suited for use in a wide variety of processing systems including other electrostatographic systems and is not necessarily limited in application to the particular embodiment or embodiment shown herein.

The producing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles as will be discussed in greater detail hereinafter.

Sheets 31 of the final support material are supported in a stack arranged on an elevated support tray of high capacity feeder apparatus 100. With the stack in the high capacity feeder at its elevated position, the sheet separator segmented feed roll 27 are actuated to initiate the feeding of individual sheets from the stack to registration roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

Figure 2:
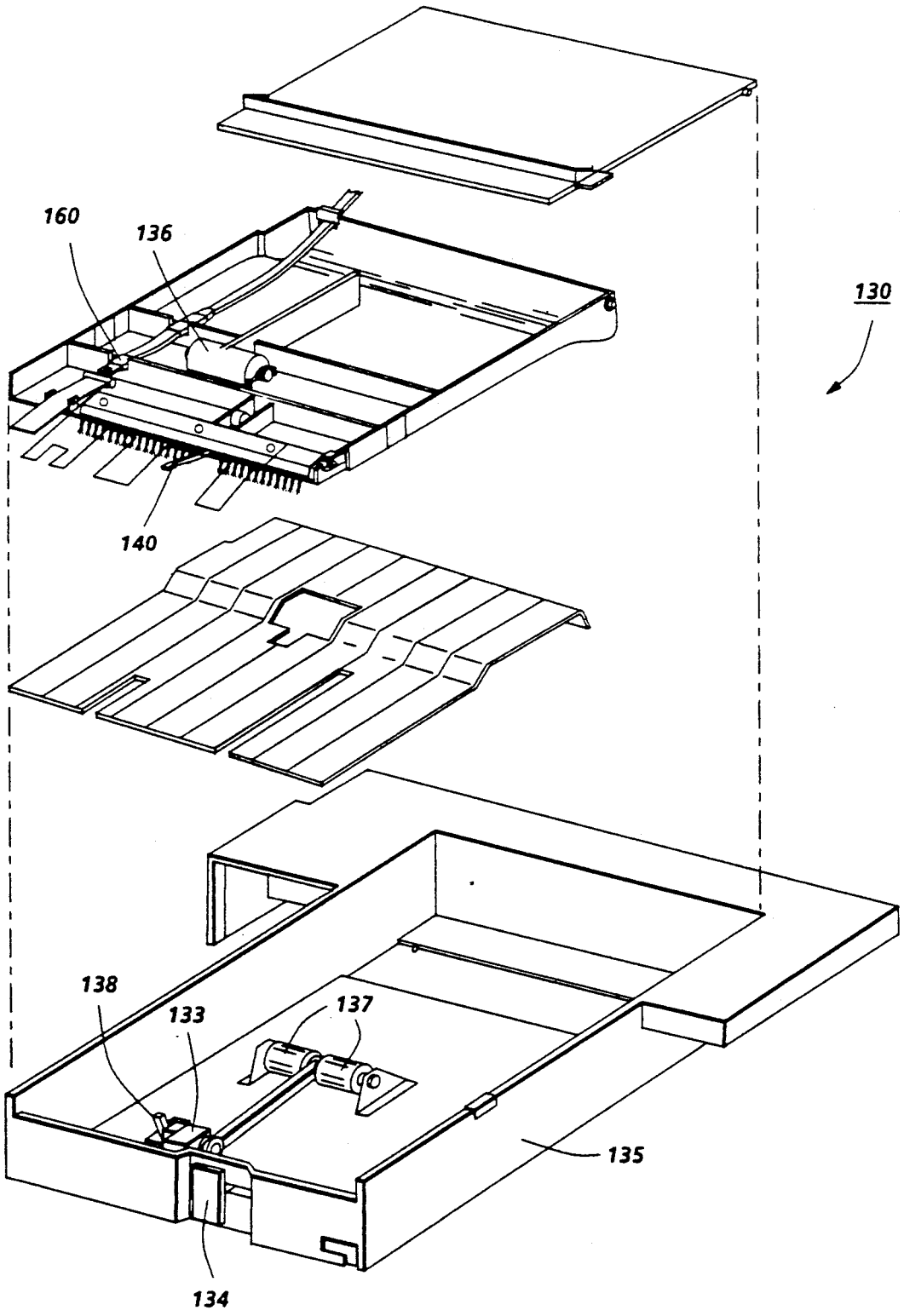
FIG. 2 is an enlarged, exploded partial isometric view of the interface module used in the high capacity feeder of FIG. 1.
Figure 3:
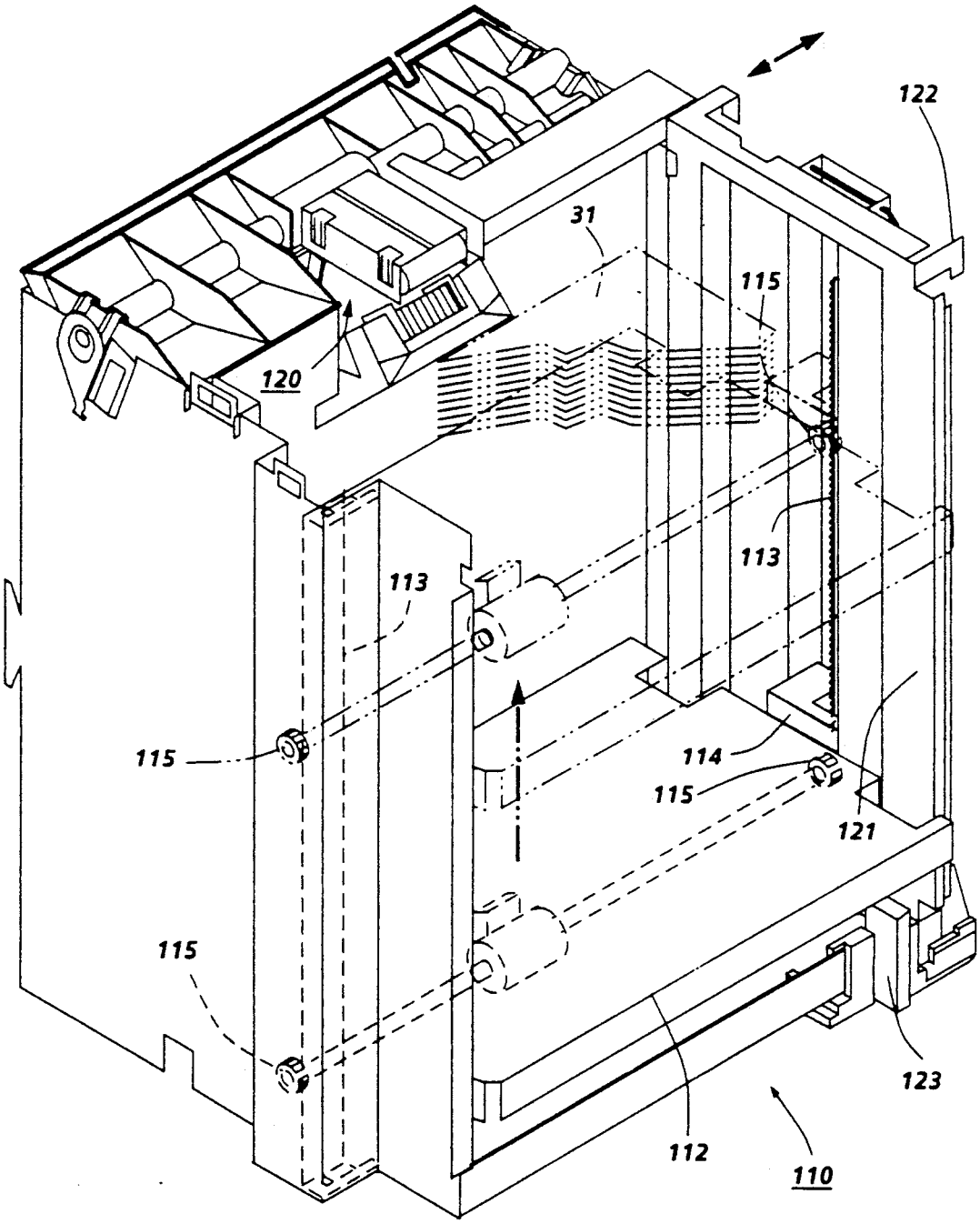
FIG. 3 is an exploded partial isometric view of the elevator module of the high capacity feeder shown in FIGS. 1 and 2.

Turning now to an aspect of the present invention, a universal non-dedicated high capacity feeder 100 is shown in FIGS. 1-3. The feeder is of two-piece design consisting of a paper elevator module 110 and a separate paper handling and interface module 130. The paper elevator module 110 is fully enclosed with a motorized tray capable of holding about 2600 sheets and is rigidly mounted to the processor stand. The function of the elevator is to raise the paper stack as required to present the top sheet of the stack at a pre-specified feed height so that it can be transferred into the interface module. The elevator module incorporates a sheet separation device which can be of either the forward buckle snubber type or the friction retard feed type disclosed or any other conventional feed apparatus.

Interface module 130 inserts into one of the processor cassette slots in the same manner as a normal paper cassette tray and transports the sheets from the elevator module to a position where they can be picked up and fed by the processor paper handling mechanism. This interface module or cassette is electrically coupled to the elevator module by way of a conventional connector interface and controls the feeding of sheets from the stack by sensing the trail edge of each sheet as it is fed into the processor. Each time the recording apparatus removes the sheet from the interface cassette, the next sheet is stripped from the stack in the elevator and delivered to the interface cassette ready position prior to the beginning of the next recording cycle. This process continues any time the recorder 10 is used until all 2600 sheets from the high capacity feeder have been used.

Contrary to the problems outlined hereinbefore of prior high capacity feeders, the two-piece construction of the present invention consisting of the paper elevator and interface cassette means that that the high capacity feeder can readily be adapted to other recorders. The interface cassette enclosure need only be modified to accommodate the size and relative position of the cassette slot in the new recorder. Further, the high capacity feeder has its own microprocessor and is totally self-contained electronically with no logic interface to the recorder or processor 10. As a result, there is no special requirement of the processor logic to allow for a feeder and no modification of the feeder logic required to adapt it to different recorders. This design will, therefore, yield significant cost savings over prior art high capacity feeders. In addition, the separate interface cassette is configured to be easily removed from the processor slot without moving or disconnecting the paper elevator. High capacity feeder 100 is inactivated once the interface cassette is removed from the recorder. The feed mechanism in the paper elevator and interface cassette is automatically activated whenever the interface cassette is inserted into the slot. This slot is therefore available for use with any of the normal cassettes in addition to the high capacity feeder with no special changeover steps required. The result is that the slot is no longer dedicated to the high capacity feeder and there is no loss of copying flexibility when used with any of the new highly-automated recorders.

Interface module or cassette 130 is essentially a sheet transport that is self-contained, i.e., it does not depend on the high capacity feeder for drive since it has its own motor 133 positioned within housing 135 as shown in FIG. 2. Motor 133 drives take away rolls 137 which transport a sheet past sheet staging switch 138 that puts the sheet in the proper location for feeding to the recorder's registration rolls 28 as long as a jam does not occur. Staging switch 138 is part of a timing scheme that tells the high capacity feeder module whether the sheet is slipping, the motor is slow, etc., and essentially maintains latitude for the processing operation. Switch 140 is an out of paper actuator for the recorder. There is no logic connection between the recorder and the interface module. Sheet transport from the high capacity feeder is initiated by optical switch 160. Segmented feed rolls 27 are actuated by an operator pressing the start-print button on the face of the recorder. Feed roll 27 contacts arm 161 of sensor 160 and depresses the arm causing it to interrupt a beam from an infrared emitting member (not shown) that comprises an emitter and a receiver which simultaneously signal a conventional microprocessor controlling the high capacity feeder to begin the sheet feeding cycle. Sheet feed rolls 27 of the recorder do not drive sheets which have been initiated from the high capacity feeder but do drive sheets out of conventional cassettes into the recorder. Segmented rolls 27 shown in FIG. 1 rotate for each copy dialed by the operator. Motor 133 drives a transport nip formed by take away rolls 137 and an idler roll housed in housing 136 which is utilized to move a sheet 31 from the interface module to registration rolls 28 of recorder 10. When the feeding sequence is initialized, a sheet staged within the interface module is driven completely out of the transport nip and directly into the registration rolls 28 in the recorder 10. The location of the transport roll nip to the registration rolls is slightly less than the shortest sheet fed through the high capacity feeder; therefore, when the sheet is completely fed out of the transport nip a buckle is created (differently for A-4 and 8.5×11" sheets) and a minimal of holding or steering influence is induced to the sheet. With the elimination of this influence, the sheet lead edge is completely and effectively allowed to register. A sheet size mechanical plate 134 is included on the input end of housing 135 for signaling the recorder. This plate, which depresses switches internal to the processor, provide information to the size of paper being fed fro the high capacity feeder.

High capacity feeder 100 includes an elevator module 110 that is adapted to hold and precisely locate a stack of sheets with an elevator motor (not shown) that negates past problems attributed to low gear reduction motor assemblies. This precise holding of elevator tray 112 is accomplished by shorting the motor with both leads tied to an equal potential when the stack reaches it predetermined location. This enables the motor to precisely locate the elevator after either driving in an upward or downward direction. Elevator module 110 is unique in that it requires no hardware in order to maintain assembly and functionality. All parts are multifunctional and interact in order to provide the needed features for assembly and maintain adequate function. The elevator utilizes movement of pinions 115 to racks 113 to convert rotational motion of the elevator motor to linear tray movement. Racks 113 are stationary and positioned in a sheet metal frame. A guide block 114 positioned at the drive centerline, traveling in a sheet metal channel, assures stability of the tray 112 as it travels up and down. Guide blocks are also utilized as a bearing surface for the pinions and an interlocking device to hold the racks in place. Once sheet metal tray 112 is assembled, it adds any needed stability and captures the guide blocks, pinions, and racks while maintaining part spacing and position. A conventional photo-electrical or electro-magnetic switch senses the position of the top of the paper stock in the elevator. It signals the elevator motor to raise the tray incrementally after a number of sheets have been removed.

Intervention by an operator to locate a jam is not required in order to clear paper path jams at the paper source (interface module or elevator module). When a jam occurs at the paper source, a microprocessor in the high capacity feeder causes the elevator tray/sheet stack to descend. Prior to the lowermost point of elevator travel, the elevator will automatically unload the take away roll nip 120 by way of a simple lever/-loading/unloading bar arrangement (122). When the jam has been removed and all other conditions satisfied, the elevator will be allowed to ascend and the unload bar 122 (spring loaded) will again re-establish the take away roll drive nip automatically. The unload bar is one of three parts comprising the actual unload/load approach. The unload bar is a means of transmitting motion and spring force for the take away roll nip. The actual final loaded member is a thin 4 mm shaft (not allowed to rotate) supported accurately at one end and loaded at the other with the unload bar which contains the take away roll idler. In order to maintain high accuracies in timing and paper position, existing paper path switches are used to provide a dual function. These switches at extremes of the paper path are utilized as feedback devices to the microprocessor in order to correct for speed, slippage, and time-to-speed variations inherent to the system. This approach of feedback can either occur once at initialization, continuously as every sheet is fed or at random intervals over the life of the unit. This approach is extremely low cost and gives benefits of each unit being custom tailored through software to run precisely and always at an optimum. Tolerances of each part, including the motor speed range, can be alleviated in this way and problems attributed to system variability from unit to unit are nonexistent. A slide member 123 is situated in front of high capacity feeder 100 for adjusting a wall 121 of the elevator module 110 through a connected lever in order to accommodate $8\frac{1}{2}\times 11''$ and A-4 long edge fed sheets.

High capacity feeder 100 affords easy access and servicing of key wear components in that the retard pad module 120 can be directly accessed only when the elevator is near its lowermost position in its travel. It is housed in a pivoting cover assembly which when rotated out towards a paper access door, the retard pad assembly can be easily removed by the operator or service technician without tools, coping with space constraints, or subjection to possible safety hazards. The roll module holds two paper drive rolls and can either be replaced by removing each from the module or the entire module can be replaced as an assembly without disassembly of other components of the high capacity feeder.

No first copy out time (FCOT) penalty is realized with use of High capacity feeder 100 if an operator decides to remove the interface module and insert a regular cassette into the now vacant slot in the recorder because the high capacity feeder feeds sheets to its own take away rolls and then to the interface module. No sheets exist at the high capacity feeder interface module transition zone. No logic connects feeder 100 with the recorder. The feeder has its own microprocessor, therefore, it is applicable to a variety of recorders. Light emitting diode icons (not shown) on the housing of the high capacity feeder indicate jams to an operator based on output from the microprocessor. The icons indicate either a jam in the interface module only, a jam in both the interface module and the feeder or in the feeder only.

It should now be understood that an entire cassette paper transport concept has been disclosed which enables the use of either a high capacity feeder or the standard machine cassettes without any disassembly or function other than cassette removal and insertion. The high capacity feeder contains a paper transport which is built into a package resembling a standard machine cassette. In doing so, removal and insertion of the standard machine cassette(s) is made possible and easy for an operator.

What is claimed is:

1. A universal non-dedicated high capacity feeder for feeding sheets into a recording apparatus, comprising:

an elevator module for lifting sheets on a tray thereof into a sheet feeding position, and removable interface module means adapted to be inserted into a cassette loading slot of the recording apparatus for transporting the sheets from the elevator module to a position where they can be picked up and fed by paper transport members of the recording apparatus, said removable interface module means including an inlet for receiving sheets thereinto from said elevator and an outlet to allow sheets to exit therefrom, and wherein said removable interface module means is adapted to be removed from the recording apparatus without removing said elevator module from the recording apparatus.

2. The feeder of claim 1, wherein said high capacity feeder includes a microprocessor.

3. The feeder of claim 1, including feed means for feeding sheets individually from said tray to said interface module.

4. The feeder of claim 2, wherein said interface module includes take away rolls for advancing a sheet received from said feed means for further processing and a motor for driving said take away rolls.

5. The feeder of claim 4, wherein said tray of said elevator module is manipulated by rack and pinion means.

6. The feeder of claim 5, wherein said pinion means is housed within a guide block positioned within a channel means of said elevator module.

7. The feeder of claim 3, wherein feeding of sheets from said elevator module is triggered by a feed roll within said recording apparatus.

8. The feeder of claim 7, wherein said feed roll is in a non-sheet feeding position during feeding of sheets from said tray of said elevator module.

9. An integral, non-sheet storing, portable and removable interface module adapted to be inserted into a cassette loading slot of an imaging apparatus for transporting sheets from a non-integral, external source to an automatic feed portion of the imaging apparatus, said interface module including feed means for driving sheets therethrough.

10. A removable copy sheet transport adapted to be inserted into a cassette loading slot of an imaging apparatus, said copy sheet transport including a motor for driving copy sheets through said copy sheet transport, staging switch means for placing a copy sheet in proper position to be received by registration rolls of the imaging apparatus, switch means for indicating an out of copy sheet state, and switch means for initiating copy sheet feeding from a separate source.

11. A universal non-dedicated high capacity feeder, comprising:

an elevator module for lifting sheets on a tray thereof into a sheet feeding position, and a removable copy sheet transport adapted to be inserted into a cassette loading slot of an imaging apparatus, said copy sheet transport including a motor for driving copy sheets through said copy sheet transport, staging switch means for placing a copy sheet in proper position to be received by registration rolls of the imaging apparatus, switch means for indicating an out of copy sheet state, and switch means for initiating copy sheet feeding from said tray of said elevator module.

12. The feeder of claim 11, wherein said high capacity feeder includes a microprocessor.

13. The feeder of claim 11, including feed means for feeding sheets individually from said tray to said copy sheet transport.

14. The feeder of claim 13, wherein said copy sheet transport includes take away rolls for advancing a sheet received from said feed means for further processing and a motor for driving said take away rolls.

15. The feeder of claim 14, wherein said tray of said elevator module is manipulated by use of a rack and pinion arrangement.

16. The feeder of claim 15, wherein said elevator module includes a channel means and a guide block positioned within said channel means for up and down movement, and wherein said pinion is housed within said guide block.

17. The feeder of claim 13, wherein feeding of sheets from said elevator module is triggered by a feed roll within said imaging apparatus.

18. The feeder of claim 17, wherein said feed roll is in a nonsheet feeding position during feeding of sheets from said tray of said elevator module.

19. In an imaging apparatus having a cassette loading slot therein connected to the automatic feed portion of the imaging apparatus and adapted to print images of page image information onto copy sheets transported thereinto from a cassette positioned within the cassette loading slot, the improvement comprising: an interface cassette adapted to be inserted into the cassette loading slot of the imaging apparatus for transporting copy sheets from another source to the automatic feed portion of the imaging apparatus, said interface cassette including means for feeding copy sheets therethrough received from said other source to the automatic feed portion of the imaging apparatus.

* * * * *